US006598535B1

(12) United States Patent
Kielsmeier et al.

(10) Patent No.: US 6,598,535 B1
(45) Date of Patent: Jul. 29, 2003

(54) COLLAPSIBLE SUPPORT FRAME FOR KINETIC ENERGY PENETRATOR

(75) Inventors: Darin L. Kielsmeier, Huntsville, AL (US); Gregory L. Johnson, Decatur, AL (US); Robert N. Evans, Huntsville, AL (US); John R. Esslinger, Jr., Huntsville, AL (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 10/034,038

(22) Filed: Dec. 31, 2001

(51) Int. Cl.[7] ..... F42B 12/06
(52) U.S. Cl. ..... 102/518; 102/374; 102/703
(58) Field of Search ..... 102/308, 374, 102/376, 489, 490, 514–518, 520–523, 703

(56) References Cited

U.S. PATENT DOCUMENTS

| | | | | | |
|---|---|---|---|---|---|
| 4,295,425 | A | * | 10/1981 | Davis | 102/376 |
| 4,633,782 | A | * | 1/1987 | Berube et al. | 102/518 |
| 4,648,324 | A | * | 3/1987 | McDermott | 102/518 |
| 4,964,339 | A | * | 10/1990 | Bastian et al. | 102/376 |
| H959 | H | * | 9/1991 | Heckman et al. | 102/489 |
| 5,649,488 | A | * | 7/1997 | Morrison et al. | 102/518 |
| 5,656,792 | A | * | 8/1997 | Rentzsch et al. | 102/489 |

FOREIGN PATENT DOCUMENTS

| | | | |
|---|---|---|---|
| DE | 3327945 | * | 2/1985 |
| DE | 4139598 | * | 6/1993 |
| JP | 404369400 | * | 12/1992 |

* cited by examiner

*Primary Examiner*—Harold J. Tudor
(74) *Attorney, Agent, or Firm*—Arthur H. Tischer; Dayn T. Beam; Hay Kyung Chang

(57) ABSTRACT

The Collapsible Support Frame for Kinetic Energy Penetrator supports a long-rod kinetic energy penetrator inside a kinetic energy missile air frame in handling and flight environments but, upon impact of the missile on the selected high-obliquity target, gives way. This greatly reduces the lateral loading inflicted on the penetrator by the interaction of the missile body and the target and consequently maximizes the effectiveness of the penetrator against the target. The Collapsible Support Frame comprises concentric outer and inner rings that are mounted inside the missile and designed to hold and support the penetrator. When the missile strikes the target and the extremely high impact shock loading conditions of the penetrator process occurs, the outer ring captures a high impact shock loading pulse and transmits it to the inner ring, whereupon the inner ring fails in its supportive function, thus freeing the penetrator.

6 Claims, 5 Drawing Sheets

COLLAPSIBLE SUPPORT FRAME FOR KINETIC ENERGY PENETRATOR

DEDICATORY CLAUSE

The invention described herein may be manufactured, used and licensed by or for the Government for governmental purposes without the payment to us of any royalties thereon.

BACKGROUND OF THE INVENTION

The purpose of penetrator structural support is to provide support for the long-rod penetrator within the air frame of a kinetic energy missile during the handling and flight of the missile to maintain the penetrator rigidly in place. Kinetic energy missile penetrator are usually of a diameter that is much smaller than the missile air frame and must be supported on the centerline of the missile air frame so as to maintain the proper mass and inertial properties of the missile air frame at all times until impact on the target. This ensures the proper flight characteristics of the kinetic energy missile. However, once the kinetic energy missile has impacted the target and the penetration process has begun, the structural support must give way. If the support is not removed from the penetrator at this point, it creates a lateral load on the penetrator and causes the penetrator either to bend or break and deflect a section of the penetrator off the shotline. This results in the degradation of the overall penetration capability of the long-rod kinetic energy penetrator against the target.

SUMMARY OF THE INVENTION

Collapsible Support Frame for Kinetic Energy Penetrator (hereinafter referred to as the "Collapsible Support frame" or the "Frame") is a device that supports a long-rod kinetic energy penetrator that is inside a kinetic energy missile air frame during various handling and flight stages. Upon impact of the missile on the selected high-obliquity target, however, the Collapsible Support Frame gives way, thereby removing or greatly reducing the lateral loading inflicted upon the penetrator by the interaction of the missile body and the target. Such removal or reduction maximizes the effectiveness of the penetrator.

The Collapsible Support Frame comprises concentric outer ring and inner ring that are mounted inside the missile body and are designed to hold and support the penetrator. Upon impact on the target and the resulting creation of the extremely high impact shock loading conditions of the penetration process into the target, the outer ring captures a high impact shock loading pulse and transmits it to the inner ring. The inner ring, in response, fails in its supportive function, thus freeing the penetrator.

DESCRIPTION OF THE PREFERRED EMBODIMENT

Figure 1:
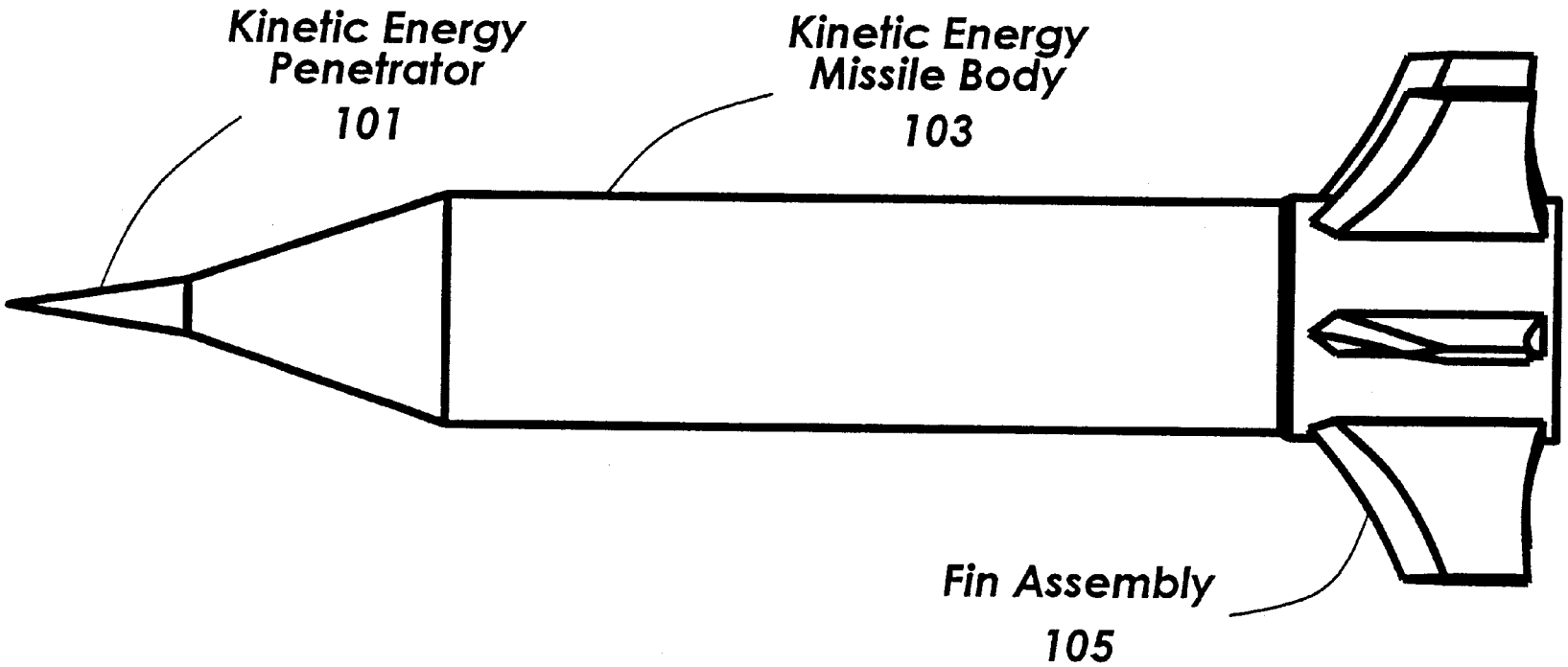
FIG. 1 presents an exterior view of a typical kinetic energy missile.

Now, referring to the drawing wherein like numbers represent like parts in each of the several figures, the structure and operation of the Collapsible Support Frame are presented in detail.

Figure 2:
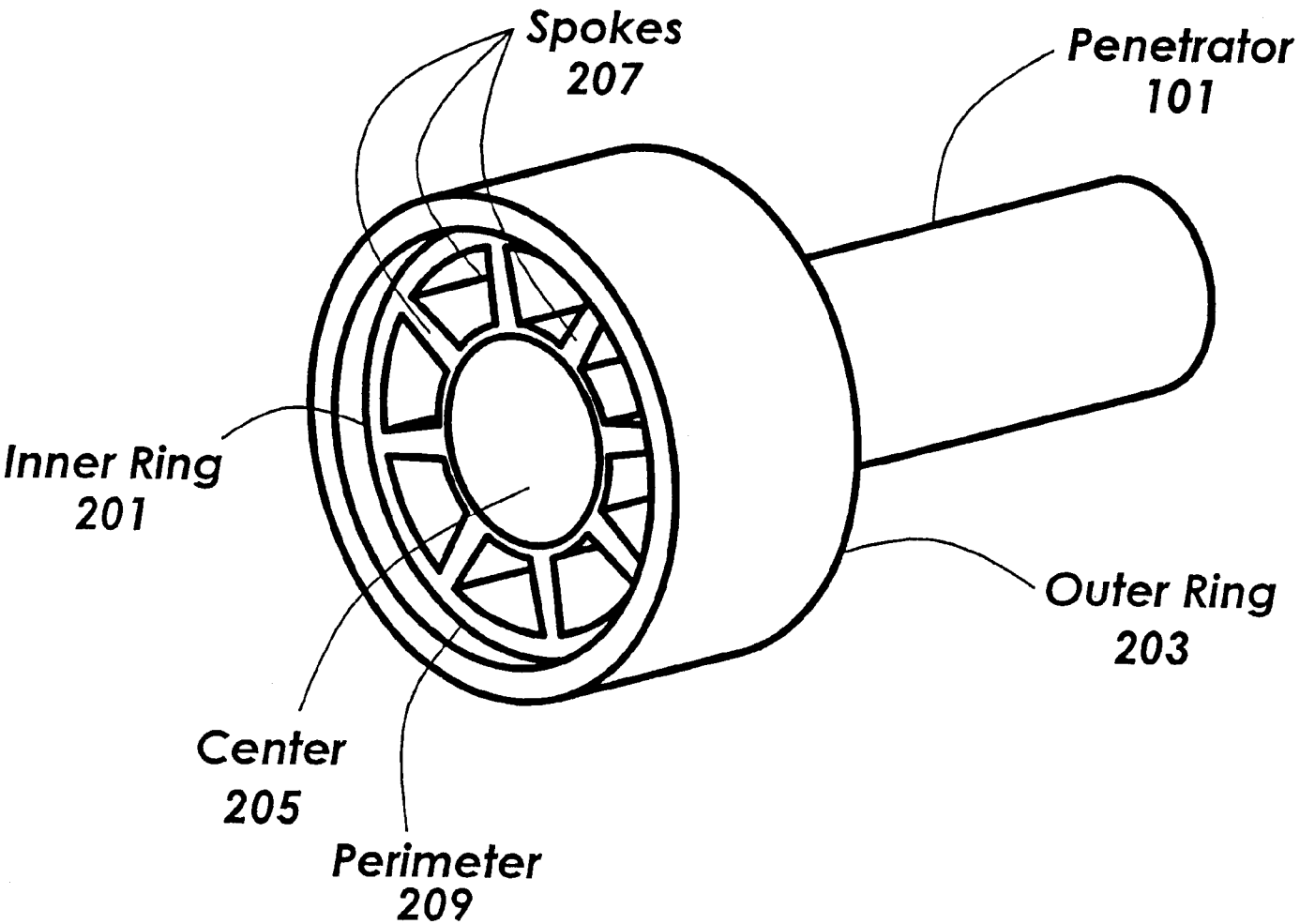
FIG. 2 shows the Collapsible Support Frame with the inner ring having a plurality of spokes.
Figure 3:
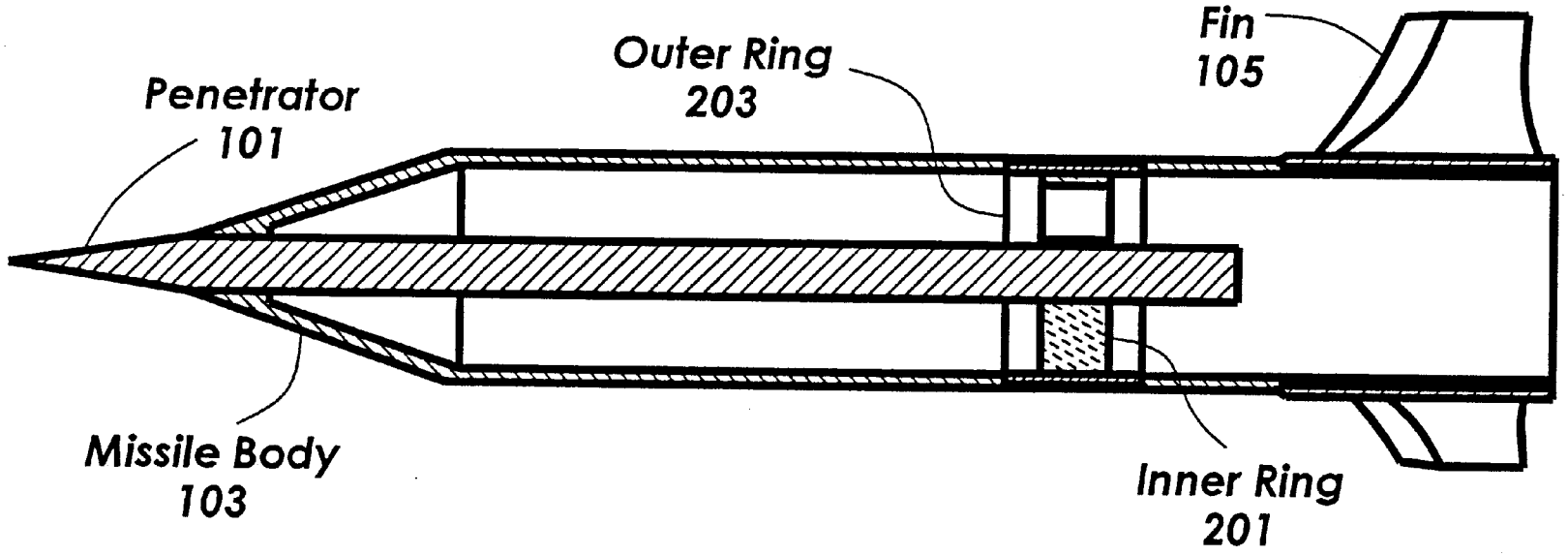
FIG. 3 is a cross-sectional view of the Collapsible Support Frame as it is positioned inside the kinetic energy missile.
Figure 4:
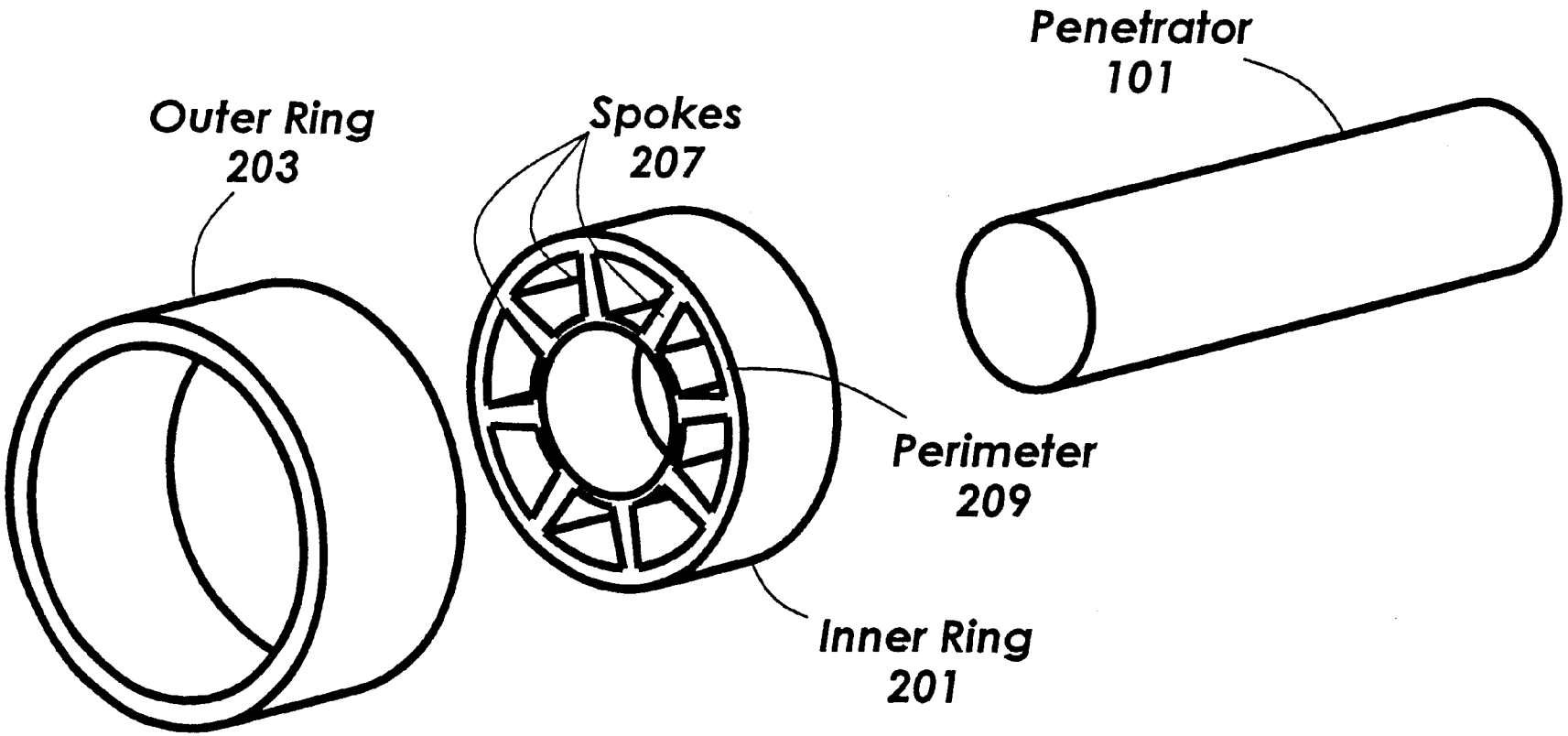
FIG. 4 is an exploded view of the Collapsible Support Frame.

FIG. 1 shows a typical kinetic energy missile carrying kinetic energy penetrator 101 with which the Collapsible Support Frame may be used. The Collapsible Support Frame is depicted as assembled in FIG. 2 while FIG. 4 presents the Frame in an exploded view. As shown in FIG. 2, inner ring 201 and outer ring 203 are concentric in arrangement relative to each other and the penetrator passes through open center 205 of the inner ring. FIG. 3 is a cross-sectional view of the Collapsible Support Frame as it is positioned surrounding penetrator 101 inside missile 103. Even though the Collapsible Support Frame is shown as an end support for the penetrator in this figure, the frame may be placed at any point along the length of the penetrator depending on the design parameters of the penetrator and the missile.

Outer ring 203 is mounted securely to the interior surface of the missile body and inner ring 201 is nestled inside the outer ring. The outer ring is a thin ring made of a high-density material such as steel or copper that is capable of capturing a high impact shock loading pulse whereas the inner ring is comprised of a low-density composite material such as carbon phenolic or carbon graphite that cannot support either a tensile or compressive high level shock pulse from target impact. The pairing of the high-density outer ring and the low-density inner ring must be such that the shock impedance mismatch is conducive to high-energy transmission from the outer ring to the inner ring.

As shown in the figures, the inner ring is in contact with both the penetrator and the outer ring. This arrangement allows the inner ring to support the penetrator during the handling and flight of the missile but also to receive the high impact loading pulse transmitted by the outer ring upon impact of the missile on the target When the missile strikes the selected high-obliquity target, a high-level impact shock pulse loading condition occurs. The impact shock pulse is captured in high-density outer ring 203 and transmitted to low-density inner ring 201. As the impact shock propagates through the inner ring, the inner ring fails in its support function of penetrator 101 because the compressive or tensile impact shock pulse is orders of magnitude greater than the load-carrying capability of the low-density composite material comprising the inner ring. Once the inner ring has failed in its supportive function, it is no longer capable of transmitting a lateral loading condition to the penetrator. With the lateral load removed, the effectiveness of the penetrator against the target is greatly increased.

Figure 5:
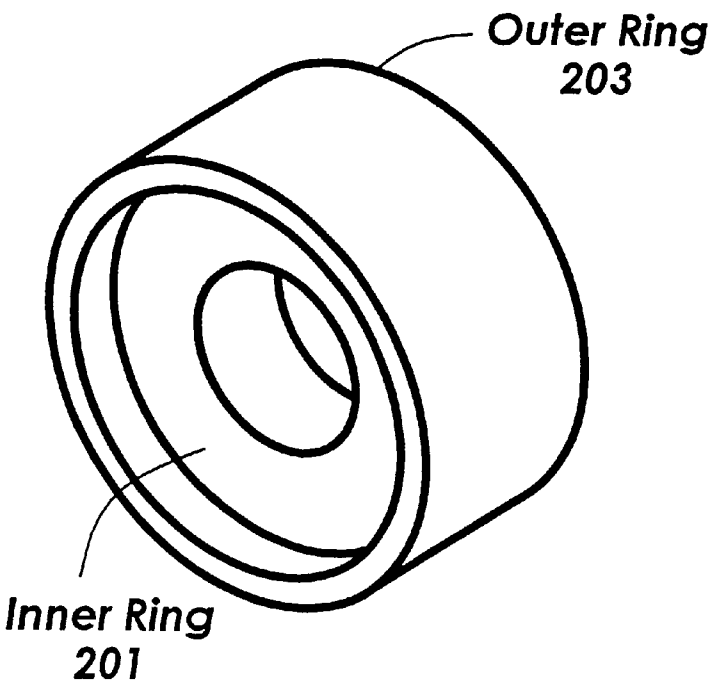
FIG. 5 depicts the inner ring as being solid.

As shown in FIG. 2, inner ring 201 may comprise a plurality of spokes 207 that extend from center 205 to perimeter 209. This configuration reduces the mass and further allows fluids such as propellant and liquid fuel to flow through the resulting spaces between the spokes from one missile compartment to another as necessary. Likewise, if seals or complete separation between compartments are desired to achieve isolation for pressure or temperature-related reasons, the inner ring can be rendered to be solid to function as a barrier as depicted in FIG. 5.

Figure 6:
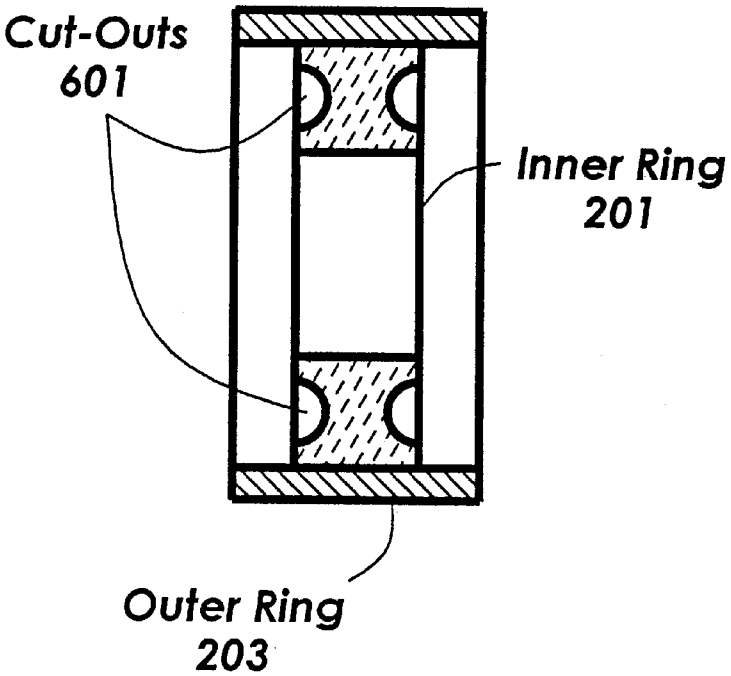
FIG. 6 shows the solid inner ring with mass-reducing cut-outs.

Although a particular embodiment and form of this invention has been illustrated, it is apparent that various modifications and embodiments of the invention may be made by those skilled in the art without departing from the scope and spirit of the foregoing disclosure. An example is making cut-outs 601 of any suitable size in the solid inner ring to reduce the mass of the ring while still maintaining a physical barrier, as illustrated in FIG. 6. Accordingly, the scope of the invention should be limited only by the claims appended hereto.

We claim:

1. A system for supporting and maintaining a penetrator inside a kinetic energy missile during said missle's flight toward a pre-selected high-obliquity target for impact with said target, said impact generating a shock pulse, said system comprising a missile carrying a penetrator therein, said missile having interior surface and; a collapsible supporting frame, wherein said collapsible supporting frame comprises: an outer ring comprising a material of first density, said outer ring being mounted on and completely within the interior surface of said missile and captureing said shock pulse; an inner ring comprising a material of second density, said second density being lower than said first density, and said inner ring having a perimeter and an open center, said center accommodating said penetrator therethrough and securing said penetrator during the flight of said missile, said outer and inner rings being concentric said inner ring being completely nested inside outer ring and position to be in contact with each other such that said outer ring transmits said shock pulse to said inner ring to cause the collapse of said inner ring and removal of lateral load from said penetrator, thereby maximizing the effectiveness of said penetrator against said target.

2. A system as set forth in claim, 1 wherein said outer and inner rings are located at any pre-selected point along the length of said penetrator.

3. A system for supporting and maintaining a penetrator inside a kinetic energy missile during said missile's flight toward a pre-selected high-obliquity target for impact with said target, said impact generating a shock pulse, said system comprising: a missile carrying a penetrator therein, said missile having interior surface and; a collapsible supporting frame, wherein said collapsible supporting frame comprises: an outer ring comprised of a material of first density, said outer ring being mounted on said interior surface of said missile and capturing said shock pulse; an inner ring comprised of a material of second density, said inner ring having a perimeter and an open center, said center accommodating said penetrator therethrough and securing said penetrator during the flight of said missile, wherein said second density is lower than said first density and said outer ring comprises steel or copper and said inner ring comprises carbon phenolic or carbon graphite, and said inner ring is contactably nestled inside said outer ring such that said outer ring transmits said captured shock pulse to said inner ring to cause the collapse of said inner ring support, thereby freeing said penetrator and maximizing the effectiveness of said penetrator against said target.

4. A system as set forth in claim 3, wherein said inner ring comprises a plurality of spokes extending from said center to said perimeter.

5. A collapsible frame as set forth in claim 3, wherein said inner ring is a solid annulus, said annulus providing a tight seal between multiple compartments of said missile while concurrently supporting said penetrator passing through said open center.

6. A collapsible support frame for supporting and rigidly maintaining a penetrator inside a kinetic energy missile, said missile having interior surface, during said missile's flight toward a pre-selected high-obliquity target, said frame collapsing and removing lateral load from said penetrator upon said missile's impact on said target and consequent generation of a shock pulse, said collapsible frame comprising: an outer ring comprised of a material of first density, said outer ring being affixed onto and completely within the interior surface of said missile and capturing said shock pulse; an inner ring comprised of a material of density, said second density being lower than said first density, and said inner ring having a perimeter, an open center and a plurality of spokes extending between said center and said perimeter, said center further accommodating therethrough said penetrator and securing said penetrator during the flight of said missile, said outer and inner rings being concentric said inner ring being completely nested inside said outer ring and positioned to be in contact with each other such that said outer ring transmits said shock pulse to said inner ring to cause the collapse of said inner ring support and removal of lateral load from said penetrator, thereby increasing the effectiveness of said penetrator in penetrating said pre-selected target.

* * * * *